US005862990A

United States Patent [19]

White

[11] Patent Number: 5,862,990

[45] Date of Patent: Jan. 26, 1999

[54] TRAMPOLINE WATER SPRAY DEVICE

[76] Inventor: Jerry White, 124 Horseshoe Rd., Columbia, Miss. 39429

[21] Appl. No.: 681,286

[22] Filed: Jul. 22, 1996

[51] Int. Cl.[6] ..... B05B 15/00

[52] U.S. Cl. ..... 239/289

[58] Field of Search ..... 239/289, 562; 482/27

[56] References Cited

U.S. PATENT DOCUMENTS

| | | | |
|---|---|---|---|
| 2,770,812 | 11/1956 | Whiteside | 4/145 |
| 3,539,181 | 11/1970 | Larsen | 239/289 X |
| 4,925,099 | 5/1990 | Owen . | |
| 4,961,535 | 10/1990 | Skibik | 239/289 |
| 5,027,455 | 7/1991 | Commisso et al. | 239/289 X |
| 5,322,342 | 6/1994 | Gange | 239/289 X |
| 5,637,057 | 6/1997 | Collura | 482/27 |

*Primary Examiner*—Kevin Weldon

*Attorney, Agent, or Firm*—Garvey, Smith, Nehrbass & Doody, L.L.C.

[57] ABSTRACT

A trampoline water spray device having a tubing which can be attached to a trampoline, the tubing being perforated with a plurality of holes, and where the tubing can be connected to a source of pressurized water and the pressurized water can flow from the plurality of holes to create a plurality of sprays around the circumference of the trampoline.

20 Claims, 1 Drawing Sheet

TRAMPOLINE WATER SPRAY DEVICE

BACKGROUND OF THE INVENTION

1. Field of the Invention

The present invention relates to a water sprinkling/spraying device for use with a trampoline.

2. General Background

Trampolines are well known in the art for providing both recreation and physical fitness exercise. Because of their size and the nature of their use, however, trampolines are generally used out of doors. Accordingly, it is not uncommon that trampolines are used in locations that are unprotected from sunlight and are not climate controlled.

Additionally, the use of trampolines generally requires a degree of physical exertion. Because trampolines are generally used out of doors and under conditions which frequently subject the user to heat and sunlight, there is a need to provide a way to cool the trampoline user while still allowing the user to enjoy the device in its typical outdoor setting.

Since trampolines can frequently be an important part of a child's, as well as an adult's, physical fitness regime, it is particularly important to provide a way of cooling the trampoline user thereby allowing the user to both enjoy and benefit from extended trampoline use.

The present invention answers such a need by providing a water spray device to cool and refresh the trampoline user while the trampoline is in use.

SUMMARY OF THE PRESENT INVENTION

The present invention provides a water spraying device for use with trampolines.

More particularly, the present invention provides a water spraying device comprised of a tubing perforated with holes, which tubing can be attached to a source of water, such as a common municipal water source or a water pump, where the tubing can be placed about the circumference of a trampoline in order to provide a water spray in the vicinity of the trampoline users.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
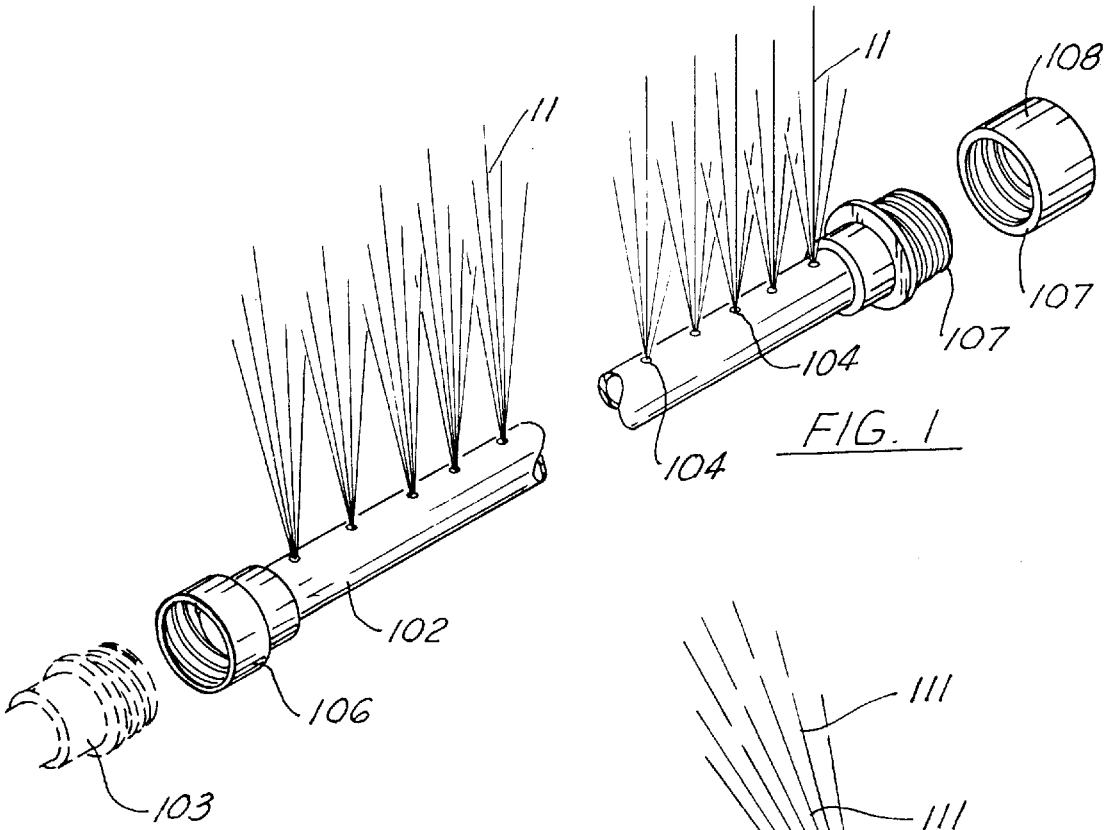
FIG. 1 shows a section of the water spray device of the present invention.

In a preferred embodiment of the present invention, the invention comprises a tubing (102) which can encircle the circumference (100A) of a trampoline (100), where the tubing is connected to a pressurized source of water, such as a municipal water source or a water pump (103), and the tubing is perforated by a plurality of holes (104) through which a plurality of pressurized jets of water (111) flow upward in order to spray the trampoline user (101).

Still further, the present invention relates to a water spray device for a trampoline comprising a length of tubing such as polyethylene black plastic roll pipe (102), which has been fitted with a hose connector on one end (106), and plugged on the other end (107, 108), and which has been perforated with a plurality of holes (104), wherein the pipe is designed to be placed around the circumference (100A) of a trampoline (100) and secured thereto (110), so that the holes face substantially inwardly and upwardly regarding the center of the trampoline, and so that the tube can then be connected to a source of pressurized water (103) and the water can flow into the tube and out the plurality of holes (104) thereby forming a plurality of water jets (111) shooting from the tube and upwardly in inwardly vis a'vis the center, or user area, of the trampoline.

In another embodiment of the instant invention, the trampoline spray device comprises a non-perforated tubing, such as polyethylene black plastic roll, which can be installed around, and secured to the circumference of a trampoline. The non-perforated tubing could be supplied with a connector (106) to connect the tube (102) in fluid communication with to a source of pressurized water (103), such as a garden hose, and could be capped (107, 108) at the other end of the tube. Following attachment of the tube to the circumference of a trampoline, for example, by securing the tubing to the frame of a trampoline, the tubing could then be perforated to form a plurality of holes (104) facing inwardly and upwardly so that pressurized water flowing into the tube from the water source would exit the holes (104) in a plurality of pressurized water streams (111) flowing upwardly and inwardly in the vicinity of users (101) of the trampoline (100). In such an embodiment, the plurality of holes (104) could be made in the tubing by any device suitable for puncturing the tubing, such as an ice pick or a similar instrument.

The end of the tubing (106) that receives the incoming pressurized water source (103) may be a female connector that may threadably receive a standard garden hose male connector. The female connector may be, for example, fused to, molded with, or glued to the tubing (102).

The end of the tubing (107, 108) that is capped may be capped in any suitable manner. For example, the end may be fused or molded shut; or a male connector may be attached to the end of the tubing, as shown in FIG. 1, and may threadably receive a female cap (108); or, a cap may be fused to, molded with, or glued to the end of the tube; or a pvc nipple may be glued, fused or molded to the end of the tube with a pvc cap glued fused or molded to it.

The plurality of holes (104) may be at any distance of separation sufficient to create a suitable spray coverage as desired by the users of the trampoline. The internal diameter of the holes (104) may be anything sufficient to create a suitable spray for the users of the trampoline. In a preferred embodiment of the present invention, the holes (104) are spaced apart with about 15" to 20" between each hole, although any separation distance that creates a suitable spray is within the scope of the present invention. In a preferred embodiment, the internal diameter of the holes (104) is from about 0.5 mm to about 3 mm, although any size that creates a suitable spray is within the scope of the present invention.

In an embodiment of the present invention, a pressure regulator (105) may be added to the tubing in order to control the pressure of the water within the tubing and therefore control the force and height of the spray (111). Such a regulator may be, but is not necessarily limited to, a flow restrictor or other suitable pressure regulating device.

The tubing (102) may be attached the trampoline by, for example, securing the tubing to the circumference frame of the trampoline with a plurality of attachment straps (110) such as, for example, plastic tie straps. In a preferred embodiment, such attachment straps (110) may be located about every 5' around the circumference of the trampoline, although any placement of such straps that would secure the tubing to the trampoline is within the scope of the instant invention.

The tubing (102) may be flexible and readily bendable and positionable. Use of such flexible and positionable tubing may be particularly desirable where the tubing is produced with the holes in place before the tubing is attached to the frame of a trampoline. In such a situation, flexible tubing will readily allow one to position the attached tubing so the holes (104) point substantially upward and inward regarding the center of the trampoline so that the spray (111) may effectively wet the trampoline users (101).

In an embodiment of the present invention, the tubing (102) is sold in a package at pre-determined lengths set to encircle the circumferences of commercially available trampolines. Such tubing may come with a sealed end (107, 108) and at the other end a fitting (106) adapted to receive in liquid communication a pressurized water source, such as that from a common garden hose. A pressure control device (105) may or may not also be attached to the tubing (102). Such tubing could then be installed around the circumference of a trampoline by attaching it to the frame of the trampoline with, for example, attachments (110) which may or may not be sold with the tubing. Such tubing may be sold both with and without pre-made holes (104). In the event that the tubing is sold with holes premade, the installer of the tube will arrange the tube so that the holes (104) face substantially inwardly and upwardly so that the spray (111) is directed in the vicinity of the trampoline users (101). In the event that the tube is supplied without holes, the tubing may first be installed around the circumference of a trampoline, and then perforated by the installer in order to create holes (104) in the desired locations. In such an event, the tube may or may not be sold with a device to create the perforations, such as an ice pick or a similar type object.

In a preferred embodiment, the tube is approximately 32' in length and is made of one-half inch polyethylene black plastic roll pipe with a one-half inch female plastic garden hose connection glued in one end and a 2.5" pvc nipple glued at the other end with a pvc cap glued on it. The tube can be attached with common plastic tie straps to the circumference frame of a trampoline, regardless of the size or shape of the trampoline. The tie straps may be placed about every 5' about the circumference/top frame of the trampoline. Once the tube is attached, it can be connected to a water supply source, such as a garden hose, and the water turned on. The tube can then be perforated with an ice pick or similar instrument to create a plurality of holes each at a slight angle toward the center of the trampoline. Perforations may be made about every 15" to 20". This will create a fine mist which will spray an average of 6 to 10 feet into the vicinity of user of the trampoline with a water supply source of about 50 psi. The spray height may be regulated at the hydrant/hose supply.

Figure 2:
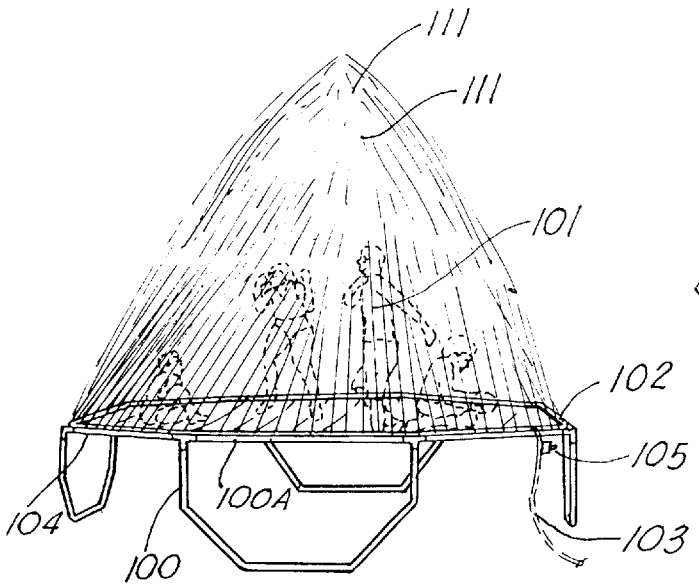
FIG. 2 shows a trampoline with users wherein the present invention is in use.
Figure 3:
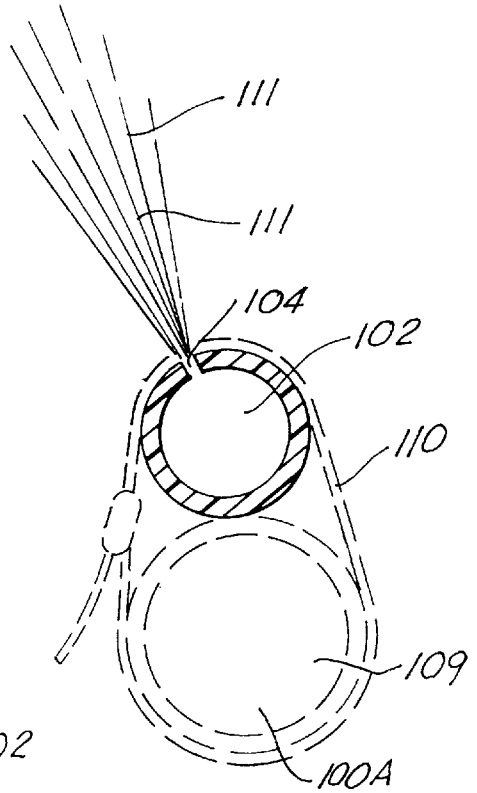
FIG. 3 shows a cross section of the tubing of the instant invention and the frame of a trampoline, showing the attachment of the tubing to the trampoline.

As can be seen in FIG. 2, trampoline 100 is sized to allow a plurality of persons 101 to play thereon simultaneously.

The following table lists the part numbers and part descriptions as used herein and in the drawings attached hereto.

PARTS LIST

| Description | Part No. |
|---|---|
| Trampoline | 100 |
| Circumference of trampoline | 100A |
| Trampoline user | 101 |
| Tubing | 102 |
| Watersource | 103 |
| Holes | 104 |
| Pressure regulator | 105 |
| Water supply connector | 106 |
| Capped end | 107 |
| End cap | 108 |
| Frame of trampoline | 109 |
| Attachment to trampoline | 110 |
| Water spray | 111 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A trampoline water spray device comprising:

a trampoline having top circumference frame and being sized to allow a plurality of persons to play thereon simultaneously;

a tubing perforated with a plurality of holes for placement on the trampoline, wherein a) said tubing can be placed around, be attached to, and conform to the top circumference frame of the trampoline;

b) said tubing can be connected to a source of pressurized water; and c) said pressurized water can flow from said plurality of holes thereby creating a plurality of sprays around the circumference of said trampoline.

2. The trampoline water spray device of claim 1 further comprising a pressure regulator so that the height and/or strength of said plurality of sprays can be regulated.

3. The trampoline water spray device of claim 2, wherein the pressure regulator is connected between said water supply and said tubing.

4. The trampoline water spray device of claim 1, wherein one end of the tubing is adapted to receive a pressurized water source and one end of the tubing is sealed.

5. The trampoline water spray device of claim 4, wherein the end of the tube that is adapted to receive the water source is fitted with a threaded female connector that is adapted to threadably receive a male connection.

6. The trampoline water spray device of claim 5, wherein the male connection is the end of a garden hose.

7. The trampoline water spray device of claim 1, wherein said tubing is attached to the top circumference frame of the trampoline with attachment straps.

8. The trampoline water spray device of claim 7, wherein the attachment straps care plastic tie straps.

9. The trampoline water spray device of claim 8, wherein the tube is polyethylene black plastic roll pipe.

10. A trampoline water spray device comprising:

a) a trampoline having a top circumference frame and being sized to allow a plurality of persons to play thereon simultaneously; and b) a tubing perforated with a plurality of holes; wherein c) said tubing is placed around, conforms to, and is attached to the top circumference frame of said trampoline and is connected to a source of pressurized water, wherein said pressurized water flows from said plurality of holes thereby creating a plurality of water sprays around the circumference of said trampoline.

11. A trampoline water spray device comprising:

a) a trampoline having a top circumference frame and being sized to allow a plurality of persons to play thereon simultaneously, b) a tubing attached to, placed around, and conforming to the top circumference frame of the trampoline and perforated with a plurality of holes, wherein c) said tubing can be connected to a source of pressurized water; and d) said pressurized water can flow from said plurality of holes thereby creating a plurality of sprays around the circumference of said trampoline.

12. The trampoline spray device of claim 11, wherein said plurality of sprays are directed substantially upwardly in inwardly from said circumference of said trampoline.

13. The trampoline water spray device of claim 11 further comprising a pressure regulator so that the height and/or strength of said plurality of sprays can be regulated.

14. The trampoline water spray device of claim 13, wherein the pressure regulator is connected between said water supply and said tubing.

15. The trampoline water spray device of claim 11, wherein one end of the tubing is adapted to receive a pressurized water source and one end of the tubing is sealed.

16. The trampoline water spray device of claim 15, wherein the end of the tube that is adapted to receive the water source is fitted with a threaded female connector that is adapted to threadably receive a male connection.

17. The trampoline water spray device of claim 16, wherein the male connection is the end of a garden hose.

18. The trampoline water spray device of claim 11, wherein said tubing is attached to the top circumference frame of the trampoline with attachment straps.

19. The trampoline water spray device of claim 18, wherein the attachment straps are plastic tie straps.

20. The trampoline water spray device of claim 19, wherein the tube is polyethylene black plastic roll pipe.

* * * * *